United States Patent [19]

Kwan

[11] 3,978,964

[45] Sept. 7, 1976

[54] MAGNETIC HEAD CONTROL ASSEMBLY FOR A MAGNETIC PASSBOOK PRINTING SYSTEM

[75] Inventor: Okun Kwan, Trumbull, Conn.

[73] Assignee: Bunker Ramo Corporation, Oak Brook, Ill.

[22] Filed: July 31, 1974

[21] Appl. No.: 493,398

[52] U.S. Cl. ..... 197/127 R; 197/1 R; 197/19; 235/61.12 M; 283/57; 360/101

[51] Int. Cl.[2] ..... B41J 13/12; B41J 19/92

[58] Field of Search ..... 197/1 R, 19, 127 R, 197/176, DIG. 9; 360/101, 121; 235/61.12 M; 283/6, 57, 63 R, 63 A, 64, 66 R, 66 A

[56] References Cited

UNITED STATES PATENTS

| | | | |
|---|---|---|---|
| 2,798,725 | 7/1957 | Marshall | 360/101 X |
| 2,928,079 | 3/1960 | McNutt | 360/121 X |
| 2,936,870 | 5/1960 | Schmidt | 197/127 R |
| 2,961,645 | 11/1960 | Dickinson | 360/121 |
| 2,963,690 | 12/1960 | Holman | 360/121 |
| 3,040,860 | 6/1962 | Montross et al. | 197/127 R |
| 3,353,168 | 11/1967 | Poumakis | 360/121 |
| 3,472,970 | 10/1969 | Basseches | 360/101 |
| 3,508,032 | 4/1970 | MacDuffee et al. | 197/127 R X |
| 3,553,649 | 1/1971 | Madge et al. | 197/127 R X |
| 3,578,129 | 5/1971 | Kato et al. | 197/176 X |
| 3,662,122 | 5/1972 | Grundtner et al. | 360/121 |
| 3,668,669 | 6/1972 | Marino et al. | 360/121 |
| 3,753,255 | 8/1973 | Di Veto | 235/61.12 M X |
| 3,756,365 | 9/1973 | Markakis | 197/19 X |
| 3,780,264 | 12/1973 | Kondur et al. | 235/61.12 M X |
| 3,823,405 | 7/1974 | Andreaggi et al. | 235/61.12 M X |

FOREIGN PATENTS OR APPLICATIONS

| | | | |
|---|---|---|---|
| 1,163,857 | 2/1964 | Germany | 197/DIG. 9 |

*Primary Examiner*—Edgar S. Burr
*Assistant Examiner*—Paul T. Sewell
*Attorney, Agent, or Firm*—Thomas G. Devine; F. M. Arbuckle

[57] ABSTRACT

A printing apparatus is provided for printing on a document or bank passbook which has affixed thereto a magnetic stripe on which information with respect to the print operation is written and/or read by a magnetic head scanning assembly. The printing apparatus includes a document holder for accommodating the document to be printed on, and an automatic line positioning device in the form of a stepper motor to move the holder, and accordingly the document, to the line to be printed on as recorded on the magnetic stripe, at which time the platen is advanced against the document, and the data printed on the line by the print head. The magnetic head scanning assembly at beginning-of-stripe position is retracted from the magnetic stripe on the document, and when actuated, advances the head to contact the magnetic stripe to read data on the stripe. Having obtained print line information from the magnetic stripe, the passbook is automatically positioned at the proper print line by the stepper motor, the platen is advanced, and the data is printed thereon. The platen is retracted and the passbook is returned to the home position, where the platen is again advanced, and the magnetic head scanner assembly writes updated information on the magnetic stripe. Printing apparatus is also provided with an aperture in the document receiving means which positions the document in the holder, the document receiving means having an aperture therein to accommmodate the movement of the magnetic scanning head assembly. The aperture is provided with pivoted fingers which prevent the document from hanging up in the aperture or on the platen, and insure that the document is guided into the holder.

8 Claims, 11 Drawing Figures

Fig. 4
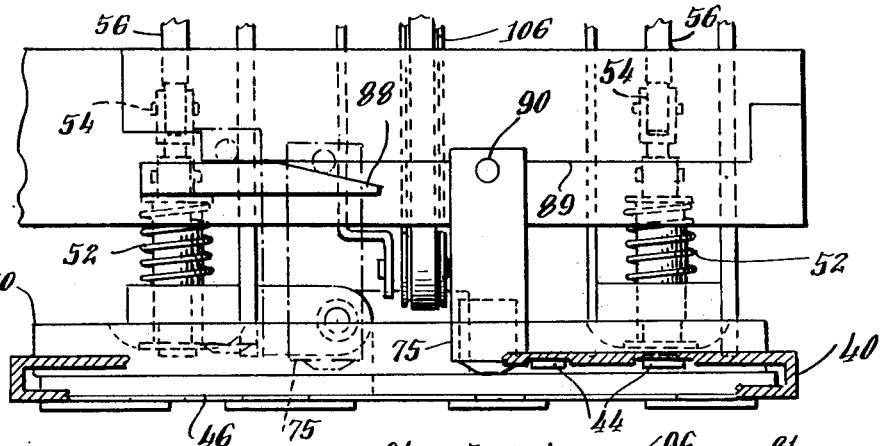
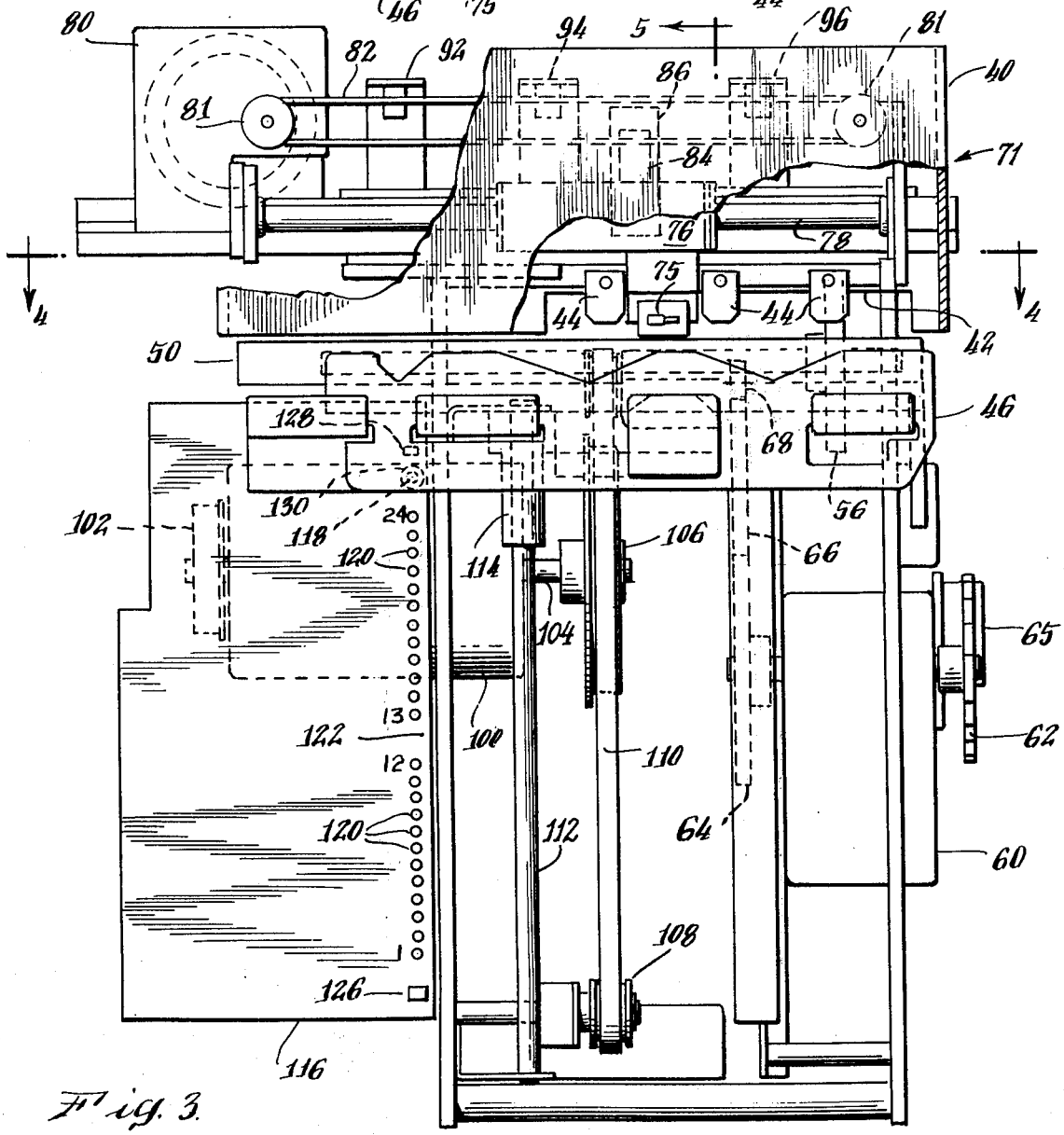
Fig. 3

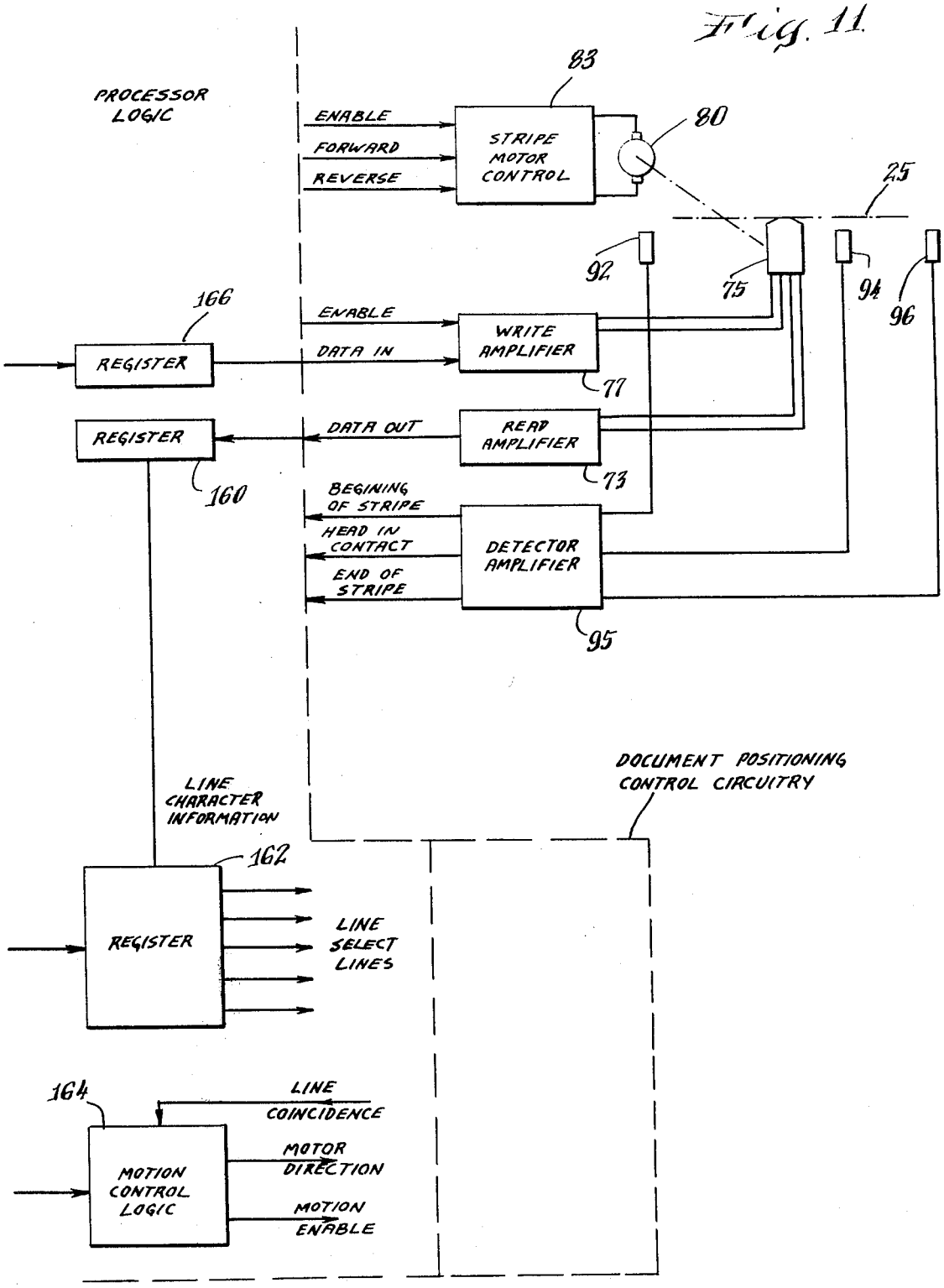
Fig. 11
PROCESSOR LOGIC
ENABLE
FORWARD
REVERSE
STRIPE MOTOR CONTROL
83
80
25
92
75
94
96
166
REGISTER
ENABLE
DATA IN
WRITE AMPLIFIER
77
REGISTER
DATA OUT
READ AMPLIFIER
73
160
BEGINING OF STRIPE
HEAD IN CONTACT
END OF STRIPE
DETECTOR AMPLIFIER
95
DOCUMENT POSITIONING CONTROL CIRCUITRY
LINE CHARACTER INFORMATION
162
REGISTER
LINE SELECT LINES
164
LINE COINCIDENCE
MOTION CONTROL LOGIC
MOTOR DIRECTION
MOTION ENABLE

MAGNETIC HEAD CONTROL ASSEMBLY FOR A MAGNETIC PASSBOOK PRINTING SYSTEM

BACKGROUND OF THE INVENTION

This invention relates to a printing apparatus for performing printing operations on a document containing a magnetic stripe means on which information with respect to the printing operation is recorded and/or read therefrom to aid in the automation of the printing process.

In an application Ser. No. 433,096 filed Jan. 14, 1974 (continuation of Ser. No. 249,856 filed May 3, 1972 now abandoned) entitled "Printer Having Document Thickness Compensation Device," by O. Kwan, J. J. Boyce & W. A. Ottersen, which is assigned to the assignee of the present invention, there is described a printing apparatus which may be used in a bank teller terminal for performing printing operations on a document such as a bank passbook. The document is inserted in a document holder in the printing apparatus, and the teller or operator either manually moves the holder with the document positioned therein to the desired printing position, or by key operation actuates a document holder transport means to move the document into the desired print position. The operator must then transmit information with respect to the account number to the central processor or computer before the print operation takes place.

It would be desirable to automate the printing process as much as possible by eliminating as many nonessential manual operations as possible, in order to restrict the possibility of human error. In accordance with the present invention, a magnetic stripe or patch is affixed to the document, on which pertinent information, e.g. account number, balance, next line to be printed, etc., is recorded and/or read therefrom by a magnetic read/write head scan assembly which scans the magnetic stripe. The print apparatus may be automatically controlled by the information appearing on the magnetic stripe, and then updated for performing subsequent printing operations thereon. In the operation of the magnetic head scanning assembly, it is desirable that the function of the scanning head assembly not interfere with the operations of the printing apparatus in which it is incorporated, and further that the scanning head is not damaged in its operation by contact with other than the magnetic stripe which it is to reach, nor the magnetic stripe damaged by the operation of the scanning assembly. It is further necessary to provide position information with respect to the travel of the scanning assembly so that various switching operations can be performed. It is further desirable that the provision for the path of travel of the scanning assembly not interfere with the proper positioning of the document in the document holder assembly.

Accordingly, it is an object of the present invention to provide a document printing apparatus for automating portions of the printing process by data automatically recorded and/or read from the document itself.

A further object of this invention is to provide a document printing apparatus for printing on a document having a magnetic stripe positioned thereon which is scanned by a magnetic head whose operation is compatible with the rest of the printing apparatus so as not to interfere with its proper functioning.

Still another object of this invention is to provide a magnetic head scanning assembly for scanning a magnetic stripe positioned on a document to be printed upon in response to the information on the stripe which does not damage the stripe on which information is to be written and/or read, and does not damage the scanning assembly by contacting surfaces other than the stripe.

Still another object of this invention is to provide a magnetic head scanning assembly for a printing apparatus for reading and/or writing information on a magnetic stripe contained on the document to be printed upon in response to information recorded on the stripe, in which position information with respect to the path of travel of the magnetic scanning assembly is automatically provided to control the movement of the magnetic assembly and to initiate other functions in the printing operation.

SUMMARY OF THE INVENTION

In carrying out this invention in one illustrative embodiment thereof, printing apparatus is provided including a document positioning means, a printer, a compressible type platen, and an automatic line positioning means operating the document holder for positioning the document on which a data printout is made by the printer. The document, such as a bank passbook on which a printing operation is to be performed, is provided with a magnetic stripe or patch positioned on the document which is scanned by a magnetic head assembly. The magnetic head scanning assembly in its scanning path is provided with three photocells which are interrupted by the travel of the scanning assembly, establishing a beginning-of-stripe position, head-in-contact position, and an end-of-stripe position, which are used to control the travel of the scanning assembly and to initiate other control functions. In its beginning-of-stripe position the magnetic head scanning assembly is retracted from the stripe, and as it travels, moves down to contact the stripe, reading from or writing on the stripe, and then returning to the beginning-of-stripe position where it is again retracted away from the stripe. In the scanning path of the head assembly are suspended a plurality of pivotal fingers which prevent the document from being dislodged in the document holder, which are pivoted out of the way by the movement of the magnetic head assembly during its path of travel over the magnetic stripe. In operation, the document having the magnetic stripe positioned thereon is inserted in the document holder, the platen advancing, and clamping and flattening the passbook, with the document holder positioned in the home position, which readies the document for the magnetic scan assembly. Magnetic scan assembly moves from its beginning-of-stripe, or retracted position, to contact the magnetic stripe reading the data thereon, such as the old balance, account number, and print line to be printed. On reaching the end-of-stripe position, the magnetic scan assembly moves back over the stripe, retracts to the beginning-of-stripe position, and the platen retracts and the passbook is automatically positioned to the proper print line by the stepper motor in accordance with the print line information which was read from the magnetic stripe. The platen is advanced against the document and the data is printed. Then the platen is retracted and the passbook is returned to the home position, at which time the platen advances and the magnetic head scan assembly again moves in contact with the magnetic stripe to update the information on the magnetic patch, after which it returns and retracts to the beginning-of-stripe position. The platen is retracted and the passbook is released from the holder. This operation may be repeated automatically or manually, depending on the type of transaction involved and the data to be printed on the document.

The aforesaid and other objects, features, and advantages of the invention will be apparent from the following description of the preferred embodiments of the invention as illustrated in the accompanying drawing.

BRIEF DESCRIPTION OF THE DRAWINGS

FIG. 3 is a front elevational view, partly broken and enlarged, illustrating in greater detail the passbook printing station of the printing apparatus of FIG. 1.

FIG. 4 is a cross-sectional view taken along line 4—4 of FIG. 3 which illustrates the movement of the magnetic scanner used in the present invention, and illustrates the structure of the document thickness compensating mechanism employed.

FIG. 11 is a block diagram of the scanner circuits.

DESCRIPTION OF THE PREFERRED EMBODIMENTS

Figure 1:
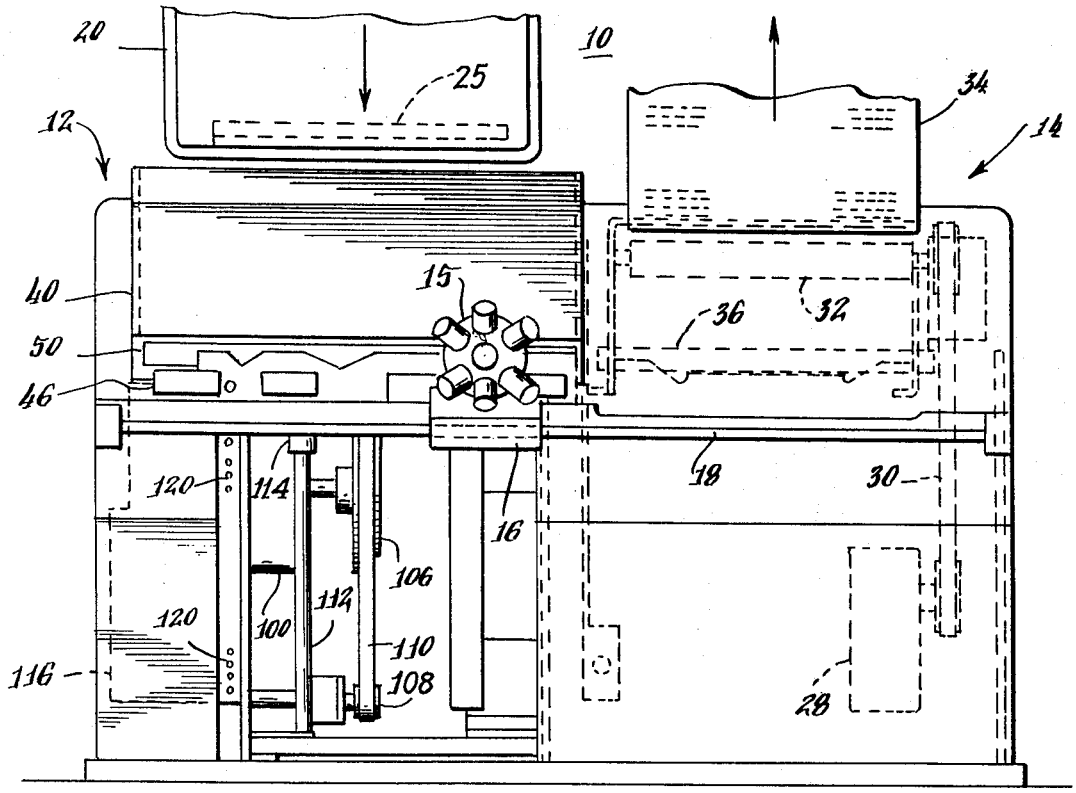
FIG. 1 is a front elevational view of a bank printer apparatus which incorporates embodiments of the present invention.

For purposes of the present disclosure, the various aspects of the present invention will be described in connection with a bank teller terminal in which the document to be printed upon is a bank passbook. It should be understood that the invention is not considered limited to the specific use chosen for purposes of illustration. In the disclosure that follows, like elements will bear like reference numerals.

Referring now to FIG. 1, a bank teller terminal is provided having the general reference numeral 10. The bank teller terminal 10 includes a document-printing station 12 and a journal-printing station 14. The bank teller terminal 10 illustrated in FIG. 1 is simplified for ease of illustration and description, and does not show a display device, such as a cathode ray tube, and a keyboard which is used by the teller to control the operation of various aspects of the bank teller terminal 10 and to provide instructions for a processor or computer to which the bank teller terminal 10 is connected, which stores account and other information which is to be stored and printed.

The document to be printed on is illustrated as a bank passbook 20, and is inserted into a document guide means or document chute 40 and directed into a document holder or carrier 46 at the document print station 12. As will be explained hereinafter, the document 20 is clamped in the holder 46, and a platen 50 is actuated to flatten out and back the document 20 for printing. The journal printing station 14 includes a roll of journal paper 34 which is driven by a motor 28 through a belt drive 30 to roller 32 to provide a paper advance for the journal paper 34. A platen 36 in line with the platen 50 of the document printing station 12 is activated when a printing operation is to take place. A matrix print head 15 is mounted on a carriage 16, which is positioned for movement on a guide rail 18 and driven by a motor see application Ser. No. 433,096 (not shown). When the document 20 is inserted in the document guide means 40 and positioned in the document holder 46, and moved to the line on the document 20 on which it is to be printed, which will be explained in detail hereinafter, the print head 15 moves across the document 20, printing on the document 20, backed by the platen 50, and duplicates the same printing on the journal 34 backed by the platen 36. The journal 34 provides a record of everything that is printed in the document printing station 12. Since all of the features of the present invention relate to the document printing station 12, a detailed description of the document printing station 12 follows.

Figure 2:
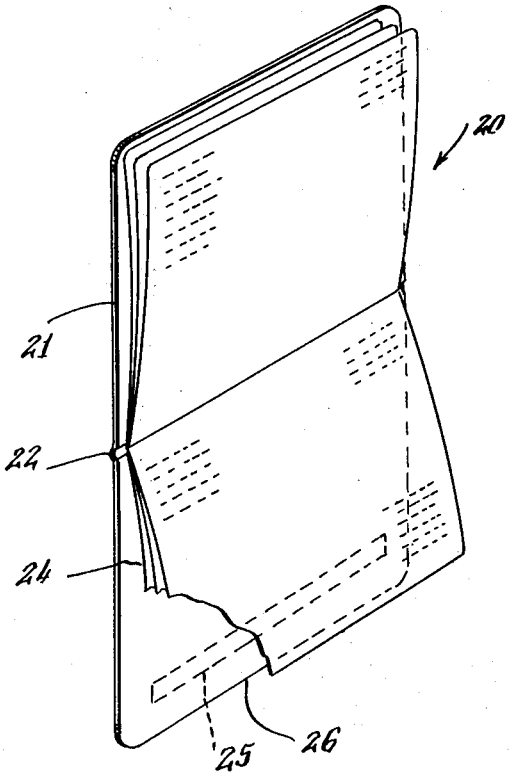
FIG. 2 is an isometric view of a bank passbook having a magnetic strip positioned thereon in accordance with the present invention which may be inserted and printed upon by the apparatus of FIG. 1.

In accordance with one feature of the present invention, the bank teller terminal 10 is provided with a magnetic capability in which the document 20 is provided with a magnetic stripe or patch 25, and a magnetic scanner (read/write) assembly referred to generally with the reference numeral 71 is provided to read and update information on the magnetic patch 25 on the document. As will be seen in FIG. 2, a passbook 20 having a cover 21, a centerfold 22, and a plurality of pages 24 fixed to the centerfold 22, is provided with a magnetic stripe of patch 25. The magnetic patch 25 must be affixed and positioned accurately on the passbook 20 in order to be inserted and cooperate with the document printing station 12 so that information on the patch 25 can be extracted or written thereon in an accurate, positive manner. The magnetic patch 25 is an adhesive backed polyester film patch having a magnetic (oxide) coating which is attached onto the cover 21 of the passbook 20, or for other applications similar to such documents. Magnetic patch 25 is positioned parallel to the centerfold 22, and also parallel to the unbound edge 26 which is nearest the last line to be printed upon the passbook 20. The patch 25 must be also located far enough from the unbound edge 26 such that the platen 50, when activated, clamps the passbook 20 with the patch 25 positioned and aligned above the platen 50. The platen 50 then, in effect, smooths out the passbook magnetic strip 25, facilitating the reading and writing thereon by the magnetic scanner assembly 71.

Figure 6:
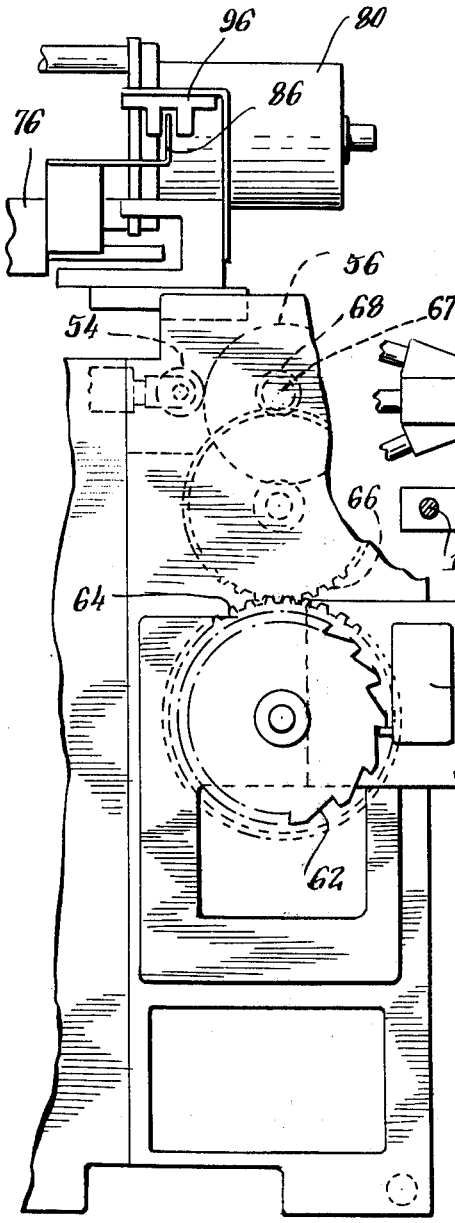
FIG. 6 is a partial side elevational view of FIG. 3.
Figure 5:
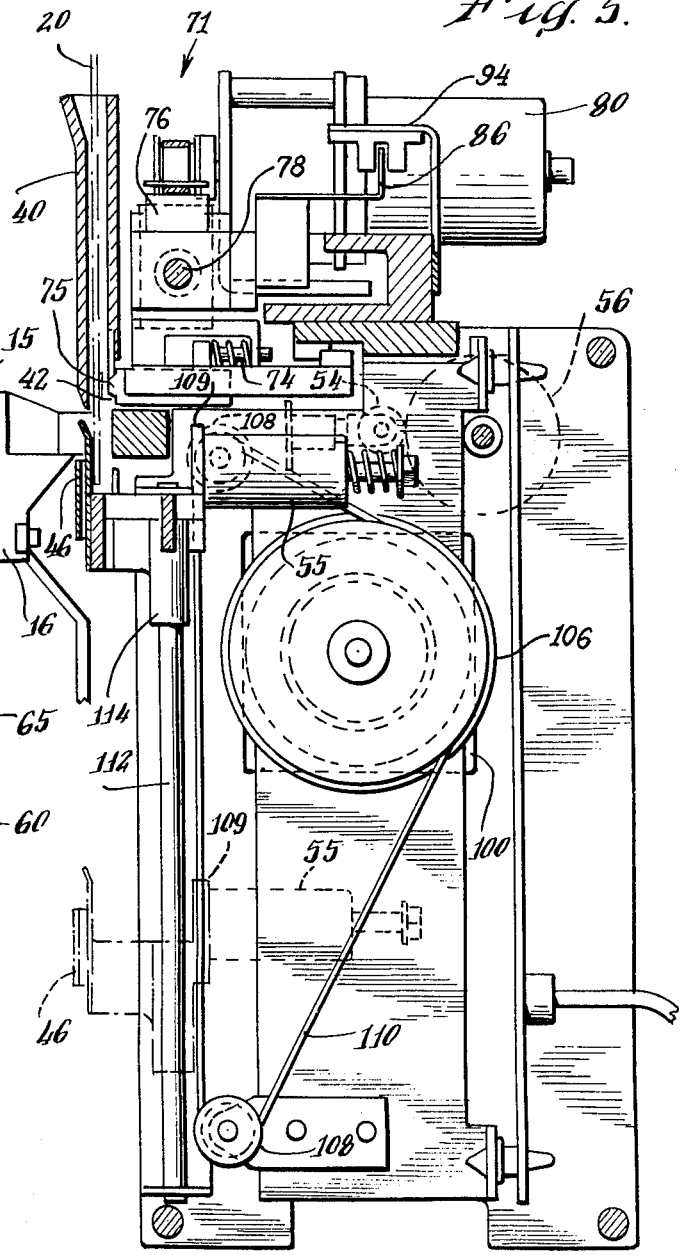
FIG. 5 is a cross-sectional view taken along line 5—5 of FIG. 3.

When the passbook 20 is inserted in the document guide means 40 of the document printer station 12, the magnetic stripe 25 of the passbook 20 faces the back of the guide means 40 with the passbook 20 being open to the page on which printing is to take place, the page facing the teller or operator of the bank teller terminal 10. The passbook 20 is inserted through the guide means 40 until it reaches the bottom of the passbook holder 46, which is somewhat U-shaped, as best seen in FIG. 5. When the passbook 20 is inserted into the passbook holder 46, the passbook holder 46 is positioned in a home position which is designed to facilitate the reading of the magnetic stripe 25 which will be explained shortly. On being positioned in the document holder 46, the passbook 20 interrupts a photodetector; see S.N. 433,096 (not shown), which activates a solenoid clamp 55 having a spring-biased plunger (more clearly shown in S.N. 433,096) which clamps the passbook 20 in the U-shaped slot of the passbook holder 46. The solenoid clamp 55 functions to hold the document 20 in the passbook holder 46 as the document 20 is moved and positioned for a printing operation on a given line. FIG. 5 illustrates the solenoid clamp 55 in the home position, and in phantom in another position where a printing operation is to take place on the document 20. This document clamping device, as well as a document-thickness compensation mechanism to be briefly described hereinafter, is disclosed in the aforesaid patent application S.N. 433,096. The document-thickness compensation mechanism is best shown on FIGS. 4 and 6. FIrst, in FIG. 6, the mechanism is driven by a motor 60 which drives a switch cam 62 and a gear 64. The switch cam 62 operates on microswitch 65 for controlling the operation of the motor 60. Gear 64 drives a gear 66 which in turn drives a smaller gear 68, which drives a shaft 67 on which cam 56 is mounted. The rotation of the cam 56 is followed by a cam-follower 54, which operates a spring-loaded plunger 52 attached to the platen 50 (see FIG. 4). When the cam 56 is moved in a high dwell position by the motor 60 driven through the series of gears, 64, 66 and 68 the platen 50 is driven forward by the action of the cam follower 54 on the spring-loaded plungers 52, clamping the platen 50 firmly against the document, which in the present invention serves a dual purpose. First, with the passbook 20 positioned in the holder 46, the system is designed such that the platen 50 contacts the passbook 20 parallel to and below the magnetic patch 25, straightening it so that the patch 25, if bent, is smoothed out to facilitate reading and writing thereon. In subsequent operations, of course, the platen 50 contacts the passbook 20, and the print head 15 produces a printing operation on the passbook 21, with the platen 50 backing the passbook 20. The platen 50 also smooths out the passbook on which the printing operations are to be performed. Although not illustrated in the present drawing, the document guide means 40 may include a pair of elongated bars spaced to provide an opening therebetween for the passage of the print head 15, with the bars in combination with the platen 50 flattening the document 20 and establishing a print plane for the printer 15. This feature is shown and described in the aforesaid application S.N. 433,096.

The magnetic scanner assembly 71 will best be seen in FIGS. 3–5. A magnetic read/write head 75 is mounted on a magnetic head carriage 76 and is spring loaded to the carriage 76 by a spring-loading mechanism 74. The spring-loading mechanism 74 accommodates surface variations in the magnetic stripe or patch 25. The surface variations in the magnetic patch may result from wrinkling or otherwise bending the passbook 20, which in turn deforms the magnetic strip 25. With the spring-loaded magnetic head 75, any variations resulting from use in handling of the passbook 20 book can be accommodated by the magnetic head 75. A carriage guide rail 78 is provided on which the carriage 76 moves. The carriage 76 is driven by a motor 80 which drives rollers 81, having a belt 82 thereon which is coupled to the carriage 76 by element 84. The carriage 76 moves along the carriage guide rail 78 in a horizontal direction. Head 75 is also free to move in an orthogonal direction with respect to the carriage 76 as is best shown in FIG. 4. Magnetic head 75 is provided with a cam follower 90 which moves on a ramp cam surface 88 and a level surface 89. Accordingly, as the carriage 76 moves from left to right, as shown in FIG. 3, the magnetic head 75 moves down the ramp cam surface 88 to position the magnetic head 75 in position to read the patch 25 on the passbook 20. As the magnetic head 75 moves back, it is retracted when the cam follower 90 comes into contact with the ramp cam surface 88 which moves the magnetic head 75 away from the passbook 20. Three photocells, e.g. an LED light coupled interrupter such as GE Model H 13 B1, numbered 92, 94 and 96 and best seen in FIG. 3, are spaced along the path of travel of the magnetic head 75 and are utilized to determine three positions of the magnetic head 75, which are a beginning-of-stripe position, a head-in-contact position, and an end-of-stripe position, respectively. Interrupter element 86 which is attached to the carriage 76 interrupts the photocell 96 in a manner best seen in FIGS. 5 and 6, which sends out a signal indicative of the magnetic head 75 position, which signal can initiate the next function. For example, if the end-of-stripe photocell 96 is interrupted, the carriage 76 is returned to the beginning-of-stripe position. The ramp cam surface 88 is located in the vicinity of the beginning-of-stripe position of the magnetic head 75, which is retracted away from the head-in-contact position on the magnetic stripe 25. The cam surface 88 extends horizontally a distance which keeps the magnetic head 75 away from the passbook 20 until the head 75 has moved to a position beyond the end extremity of the patch 25 on the passbook 20 nearest the beginning-of-stripe position, so that it doesn't engage the relatively abrasive passbook document 20 itself, but only contacts the smooth surface of the patch 25. The movement of the magnetic head 75 down onto the magnetic stipe 25 also prevents the movement of the head 75 from dislodging the magnetic stripe 25 itself, which might happen, for example, if the passbook 20 became wrinkled and the patch 25 slightly elevated, which might catch on the head 75 as it moved across. By providing a retractable head 75 as in the present invention, the magnetic head 75 does not move across or contact the ends of the patch 25, which provides a safeguard from the inadvertent peeling or dislodging of the patch 25 by the magnetic head 75. Furthermore, the magnetic head 75 is retracted after performing its function so as not to interfere with further operations of the apparatus.

As will best be seen in FIG. 3, the document guide means or chute 40 is provided with a magnetic head aperture 42 to accommodate the movement of the magnetic head 75 along the magnetic patch 25 when the passbook 20 is positioned properly in the passbook holder 46. Mounted on the document guide means 40 are a plurality of vertically extending pivotal fingers 44 which help to guide the passbook 20 into the document holder 46 and prevent the passbook 20 from hanging up on the lower edge of the magnetic head aperture 42 or the platen 50 as it is being inserted into the passbook holder 46. The vertically extending fingers 44 are easily pivoted so that the movement of the head 75 is not restricted. The movement of the head 75 pivots each of the fingers 44 out of the way as the head 75 moves in either direction along magnetic head aperture 42.

Figure 7:
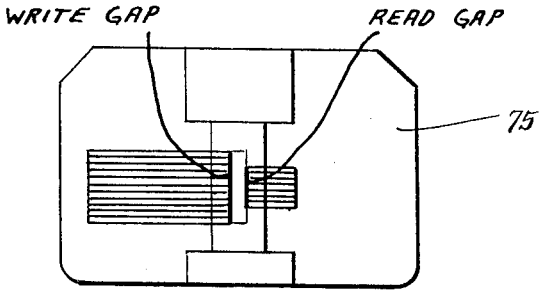
FIG. 7 is a cross-sectional view of a magnetic scanner head which may be used in the present invention.

Another feature of the magnetic head 75 is shown in FIG. 7. The write gap and the read gap have different lengths. The write gap is considerably larger than the read gap, for example 0.120 inch for the write gap compared with 0.042 inch for the read gap. This provides the magnetic system of the teller terminals 10 with tolerance with respect to the alignment of the passbook 20 with the magnetic heads 75 when the passbooks 20 are inserted in different machines than the one in which the magnetic stripe 25 was first written upon. Accordingly, the magnetic stripe passbooks 20 may be interchanged in a large number of different teller terminals 10.

In accordance with one of the concepts of the present invention, the document 20 to be printed upon is moved to the proper position before the printing operation takes place. This concept requires the passbook or document 20 to be clamped in the passbook holder or carrier 46, and the passbook holder 46 along the clamped passbook 20 is moved together to the selected line to be printed. This movement is achieved by a stepper motor 100. As will best be seen in FIGS. 3 and 5, line stepper motor 100, having a manual knob 102 thereon slip-clutched to a drive shaft 104 drives a pulley 106 having a belt drive 110 attached thereto and driven over idler pulleys 108. The belt drive 110 is coupled to the passbook holder 46 by mount 109. A bearing block 114, which is attached to the document holder 46, rides on a document guide shaft 112 which functions to guide the passbook holder 46 with the passbook 20 or document clamped therein as it traverses up and down on the guide shaft 112. In order to select the lines which are to be printed upon, a series of light sources of low persistence, such as light-emitting diodes (LEDs) 120, are provided, mounted on a circuit board 116 and adapted to be sensed by a photosensor 130, such as a phototransistor (e.g. Clairex Electronics part No. LT2160), which is mounted on the passbook holder 46. An extra light source in the form of an LED 118 is provided to indicate or position the passbook holder 46 in the home position in which the passbook 20 is inserted in the holder 46 and the initial magnetic reading is made. The remainder of the LEDs 120 are spaced for each line to be printed upon in the passbook 20, with a space 122 provided to accommodate the centerfold 22 of the passbook 20. Limit switches 128 and 126 are also provided, which are activated in accordance with the movement of the document holder 46 to limit the excursion of the passbook holder 46 with switch 128 preventing upward movement above that point, and switch 126 preventing movement beyond that point in the downward direction.

The required line is selected by turning on the LED 120 which is associated with the line desired to be printed upon. The stepper motor 100 is then activated to position the passbook holder 46. As the stepper motor 100 is stepped, the photosensor 130 affixed to the passbook holder 46 scans the LEDs 120. Upon the occurrence of a coincidence with the selected LED 120, the motion is stopped. Subsequent lines are selected in the same manner by lighting the associated LED 120 with the required line and driving the stepper motor 100 until the photosensor 130 provides coincidence therewith.

Figure 8:
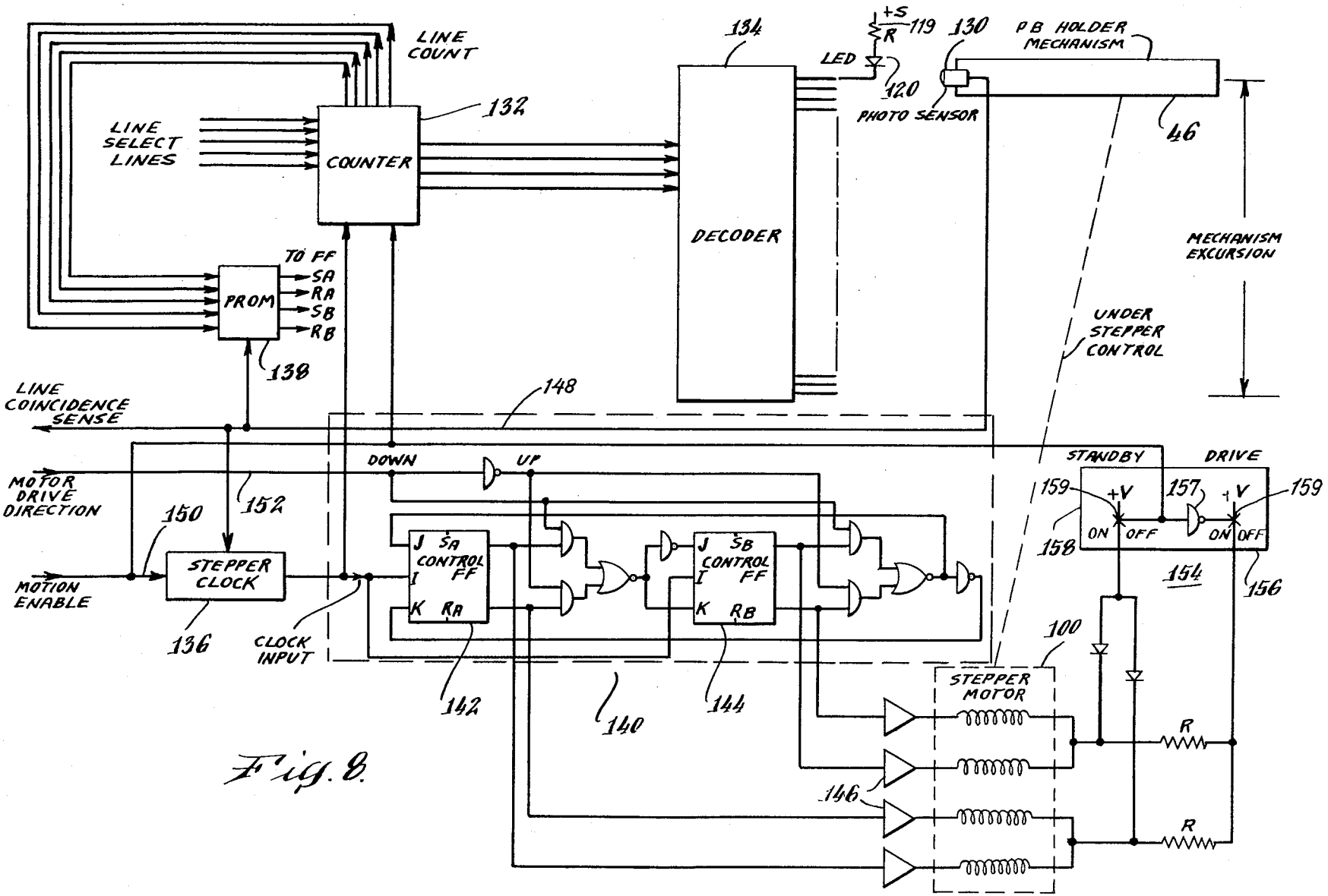
FIG. 8 is an electrical schematic diagram, partly in block form, illustrating the electrical control circuitry utilized in accurately positioning the document for printing thereon in accordance with the present invention.
Figure 9:
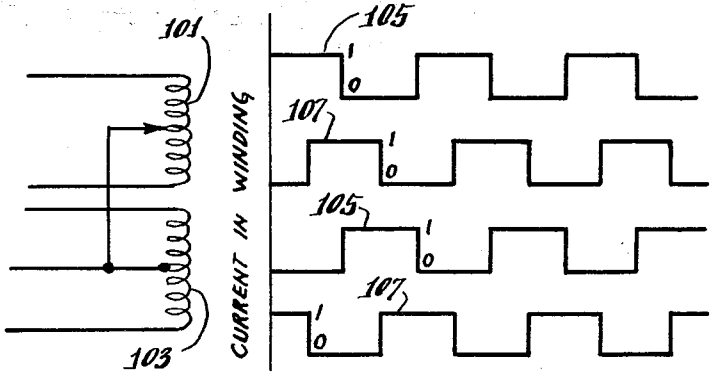
FIG. 9 shows the windings and the waveforms of the sequence of phase currents applied to the windings of the stepper motor utilized in the document-position control circuitry of FIG. 8.

FIG. 8 illustrates the document positioning control circuitry including one form of motor control circuit suitable to be utilized in the present invention. Line select information is loaded into a counter 132 which is in the form of a 5-bit binary code which is fed to a decoder 134 for translating the binary code into a 1 of 32 sequence for selecting the desired line which lights the associated LED 120. This is simply done by applying a voltage through a resistor 119 and through the LED 120, which is grounded on the other side. The circuit includes a stepper clock 136, a conventional motor control circuit 140 having flipflops 142 and 144 therein, a stepper motor 100 having two pairs of windings 101 and 103, a plurality of amplifiers 146 at the outputs of the flipflops 142 and 144 feeding the windings 101, and 103 of the stepper motor 100, and a power source 154 comprising a full drive source 156 and a standby source 158, either of which may be switched to an off position. Although various types of stepper motors and stepper motor control circuitry may be utilized, for purposes of disclosure the stepper motor 100 is illustrated as a two-phase stepper motor having four windings, two illustrated as windings 101 and two illustrated as windings 103, which are driven two at a time. FIG. 9 illustrates the connection of the windings 101 and 103, driven by the waveforms 105 and 107 which are alternately generated by the flipflops 142 and 144 of the stepper motor control circuit 140. The current 105 in the top winding 101 generates a north pole in the stator associated with the top winding 101, while the current in the lower winding 101 generates a south pole. Likewise, the currents 107 generate north and south poles in the stator for the other windings 103. All four combinations of current in the two windings are generated and given rise to four motor steps. The pattern repeats every four steps. Logic for these steps, of course, is generated by the flipflops 142 and 144 of the motor control circuit 140. Both the motor control circuit 140 and the stepper motor 100, operated with a unipolar two-phase drive, are conventional. The motor control circuit 140 has 200 steps per revolution, with 1.8° per step.

The operation of FIG. 8 for the normal (automatic) mode is to load the selected line into the counter 132, which of course provides a binary coded input to the counter 132 containing the information with respect to the line that is to be printed upon. This information is fed to the decoder 134 which activates the LED 120 associated with the line which has been selected. Since the starting position of the passbook holder 46 is in the home position, lines 150 and 152 are enabled, starting the stepper clock 136, switching the power unit 154 to full drive voltage, and the passbook holder 46 is driven downward. When the photosensor 130 on the passbook holder 46 comes upon a lit LED 120, referred to as coincidence, motion is stopped by turning off the stepper clock 136 via line 148, at which time the memory 138, which is called a program-read-only memory (PROM) control, is enabled. The PROM 138 acts as a vernier, or fine tuner, for the line positioning mechanism, and has in its memory the phase relationship of each winding for a given line. The PROM 138, whose output is fed to the set-reset inputs of flipflops 142 and 144, forces the flipflops 142 and 144 into the proper state for the proper line. Subsequent lines are selected in the same sequence, which is: light the LED 120 for the line desired; drive the passbook holder 46 to the lit LED 120, stop at the proper LED by stopping the stepper clock 126 and the stepper motor 100, and lock into the proper step selected for the given line using the PROM 138.

Figure 10:
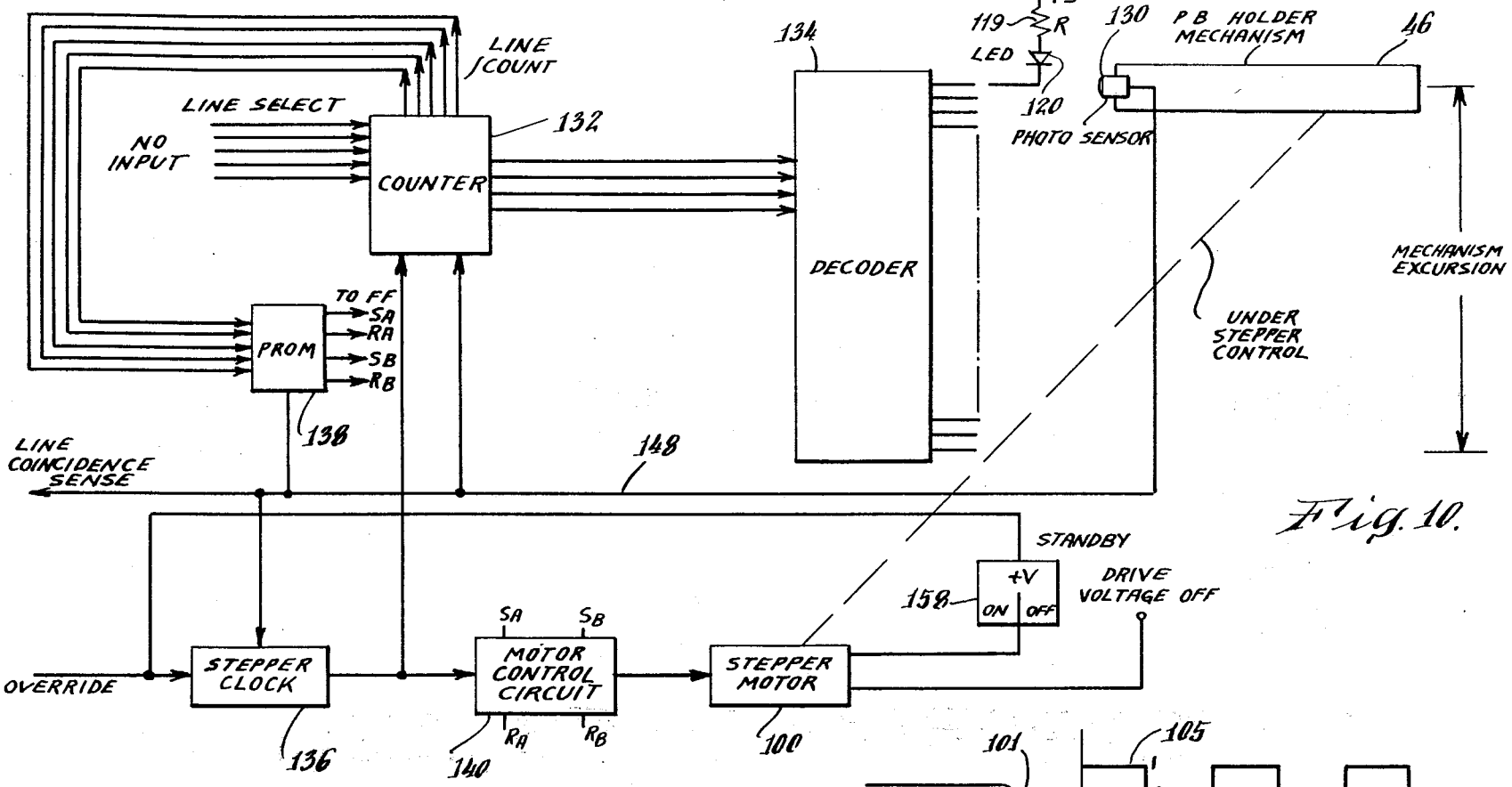
FIG. 10 is an electrical block diagram used to illustrate the operation of the circuitry of FIG. 8 when the system is operated in the override (manual) mode.

To simplify the understanding of the operation of FIG. 8 in the override (manual) mode, FIG. 8 is modified in FIG. 10 to illustrate the operation of the system in the override mode. In the override mode, the passbook holder or mechanism 46 is manually moved to the desired print line by the knob 102, slip clutched to the stepper motor shaft 104. In this mode, the LEDs 120 are cycled on sequentially at approximately a 1-khz rate by clock pulses from clock 136. When the photosensor 130 associated with the moving passbook holder 46 detects a lit LED 120, the cycling action is stopped, with only the detected LED 120 remaining on, and the control voltage to the stepper motor 100 windings 101 and 103 is switched from zero to some lower standby source 158, e.g. 5 volts vs 24 volts for full drive. As the passbook holder 46 is moved, an "electrical detent" action is thus achieved.

Line coincidence controls the detent switching action. When off coincidence, the counter 132 controlling the decoder 134, which in turn controls the LEDs 120, is cycled by the clock 136. Clock pulses are also fed from stepper clock 136 to the motor control flipflops 142 and 144 of motor control circuit 140 and power to the motor windings 101 and 103 is kept off. At line coincidence the cycling action is stopped, the clock 136 output to the control flipflops 142 and 144 is turned off, and the motor windings 101 and 103 are switched to standby power. To insure that the stepper motor 100 locks into the proper step at coincidence, the PROM 138 takes the line count stored in the counter 132 and forces the motor control flip-flops 142 and 144 to the proper state. The line information stored in the counter 132 is also fed back to the system for subsequent automatic control.

By using the document positioning apparatus described above, LEDs 120 provide a coarse alignment of the proper line, and the PROM 138 provides a vernier control to ensure that the document 20 is lined up in accordance with the line selected for printing thereon. Accurate step pulse counts are not required to accurately position the mechanism with the aforesaid control. Furthermore, the positioning device is reversible, and if manual intervention is required or deemed desirable, the control logic can be set up so that the LEDs 120 are continuously cycled as the passbook holder 146 is manually positioned. At coincidence, the counter 132 controlling the cycling is stopped and the LED 120 associated with the selected line is kept on. Furthermore, in the stand-by power mode utilized in the manual operation, the PROM 138 operates on the selected line to provide an electrical detent action when the selected line is reacted in accordance with the manual mode of operation. The information which is stored in the counter 132 when the desired manual line is reached is available for feedback to the system so that automatic operation can be resumed. Manual operation may be found desirable when new accounts or other unusual entries must be made or controlled.

The power unit 154 may be in any suitable form to provide standby or full drive voltage. As diagrammatically illustrated in FIG. 8 in the automatic mode, when the standby voltage is on, the drive voltage is off, and vice versa, indicated by an inverter 157. The control may be provided by switches 159 which are controlled by motion-enable signals from the motion control logic 164. The switches 159 are shown diagrammatically for ease of illustration and may be of any suitable type, for example, transistor switches. In the override mode, the power to the motor windings 101 and 103 is switched from off to standby at coincidence.

FIG. 11 illustrates the magnetic stripe scanner circuitry in block form. The read/write head 75 is driven by motor 80 under the control of stripe motor control circuit 83. The stripe motor control circuit 83 has enable, forward, and reverse inputs which are actuated by the processor logic. The magnetic head 75 has coupled thereto a write amplifier 77 and a read amplifier 73 which are coupled to the processor logic. The position photocells 92, 94, and 96 are coupled to a position detector amplifier 95 which is coupled to the processor logic, and are used in the processor logic for control purposes.

In operation, the stripe motor control circuit 81 "enable" and "forward" inputs are actuated pursuant to signals from the processor logic which activates scanner motor 80 driving head 75 across the stripe 25. Data for the stripe 25 is fed to the read amplifier 73 from which data output is loaded into a register 160 in the processor logic. Line character information is taken from the register 160 and loaded in a register 162 which, on command of the processor, provides line select data to the counter 132 of FIG. 8. The passbook holder 46 is then enabled by actuation of a motion control logic 164 in the processor logic to position the document 20 on the selected line which has been read from the stripe 25. When coincidence is reached, line-coincidence signals are fed back to the motion control logic 164 to terminate motion-enable signals therefrom. On multiple line prints, the processor increments the line select register 162 by one, which lights the next LED 120 corresponding to the next line to be printed on, driving the stepper motor 100 to coincidence, and the process continues.

After the print operation is performed on the selected line, the data on the magnetic stripe 25 may be updated to be used in subsequent printing operations. Data with respect to the new balance and next line to be printed upon is stored in the processor logic in a register 166 and on command may be applied to the data terminal of write amplifier 77 which is enabled along with the motor 80 for driving the head 75 across the stripe 25 to update the indicia on the stripe 25.

Having described the various parts of the document printing apparatus embodied in this invention incorporating a magnetic read/write assembly, a generalized operational sequence will be described, it being understood that the particular sequence described can be altered in accordance with the desires of the operator or teller. The bank teller initiates a transaction by inserting the passbook 20 into the holder 46 in the home position at the document print station 12. The operator then provides instructions to a central processor or computer via a keyboard which is not illustrated, which causes the platen 50 to advance after the passbook 20 is locked in the holder 46 by action of the solenoid clamp 55. The platen 50 clamps and flattens out the passbook 20 just below the magnetic path 25 for straightening and flattening the magnetic patch 25. The carriage 76 carrying the magnetic head 75 moves right and advances the magnetic head 75 which contacts the magnetic patch 25 on the passbook 20 and reads the data on the patch 25, such as the old balance, account number, and print line to be printed. When the head 75 interrupts photocell 96, the assembly then moves left and retracts the magnetic head 75 to the beginning-of-stripe position. The platen 50 then retracts to an inactuated position and the passbook 20 is automatically positioned to the proper print line by the stepper motor 100. The selected line, which information was extracted from the magnetic patch 25, is fed to the counter 132 which lights up the proper LED 120 corresponding to the line desired to be printed upon. Passbook holder 46 carrying the passbook 20 is driven by the stepper motor 100 until the photosensor 130 registers coincidence with the LED 120 associated with the line to be printed upon is reached, at which time the stepper 100 motor is shut off and the PROM 138 activated to lock in the stepper motor 100 at the proper line. Platen 50 is then advanced against the passbook 20 to smooth out the line which is to be printed upon, the data is printed by the operation of the print head 15. Platen 50 is then deactuated and the passbook holder 46 containing the passbook 20 returned to the home position provided by LED 118. Platen 50 is then advanced and the write gap of the magnetic head 75 is actuated, and moves to the right to update the information on the magnetic patch 25, providing a new balance, the account number, and the next line to be printed upon. The read/write magnetic head 75 then moves left and returns to the beginning-of-stripe position. The platen 50 is then retracted to its deactuated position and the passbook solenoid clamp 55 is released and the passbook 20 removed.

Once the passbook 20 has been inserted in the passbook holder 46 and the system activated, the aforesaid steps may be automatically completed without operator intervention. The system flexibility, however, offers the alternative of manual intervention as desired. Accordingly, the system can be run automatically, manually, or a combination of automatic and manual in accordance with the desires of the operator.

It will be apparent that various aspects of the invention are not restricted in use in a magnetic stripe passbook printing operation of the type shown and described as a bank teller terminal 10. For example, the document positioning mechanism 46 may be utilized in a number of different types of printing applications. It will also be apparent that several other features of the present invention may be utilized in different applications.

By providing a magnetic strip capability to a document printing arrangement, the intelligence written on the stripe 25 may be utilized in the automatic printing process, and can be updated after that process is completed so that in subsequent operations the updated data may be used to initiate the next print operation at a later time.

For purposes of disclosure the stripe 25 on the document 20 has been described as being magnetic, which is the preferred form. However, the benefits of this invention may be realized using stripes of other forms of medium which are capable of having indicia or information recorded upon and/or read by a suitable transducer which is compatible with the readable and recordable medium. The stripe or medium may also be an integral part of the document to be printed upon. It will also be apparent that the indicia or information on the medium may be in coded form.

Certain aspects of the present invention are related to facilitating the reading and/or writing of indicia on a stripe 25 as well as printing upon documents 20 containing such indicia, which documents 20 may be subject to abuse. Such documents tend to become bent, wrinkled, etc., due to repeated handling by the user. The present invention is capable of handling such documents. For example, the stripe 25 is positioned on the document 20 such that when inserted in the print station 12, the stripe 25 is smoothed by the clamping action of the platen 50 to facilitate reading and/or writing thereon. Furthermore, the scanning assembly 71 is provided with a spring-loaded transducer or head 75 to accommodate further variations in the surface of the stripe 25 containing the indicia. The spring-loaded transducer 75 also accommodates variations in the thickness of the documents. The platen 50 is provided with compensation means 52 to accommodate various thicknesses of documents in the print operation (see application S.N. 433,096). Since the platen 50 contacts the back of the document 20 containing the stripe 25 and positions the document 20 in the same print plane regardless of document thickness, the distance between the stripe 25 and the scanner head 75 thus also varies with the thickness of the document. Accordingly, the spring-loaded scanner head 75 is provided to accommodate this difference in spacing caused by variations in document thickness.

It should be pointed out that the terminology chosen for purposes of disclosure with respect to the position of the scanner head 75 as a beginning-of-stripe position does not mean that the head 75 is required to be located at the beginning of the stripe 25 when it is retracted therefrom. The beginning-of-stripe position is used in the context of a start, rest, or home position in which the head 75 is retracted from the stripe 25 and at rest. In this position the head 75 may be positioned beyond the left extremity of the stripe 25 if desired. In the same context, end-of-stripe position of the head 75 need not occur at the very end of the stripe 25. All that is necessary is that the end-of-stripe position occurs at some point at or beyond the end of the indicia which is to be written and/or read on the stripe 25. Accordingly, the positions may vary to fit the operating requirements of the system in which the structure is used.

Different forms of drive means and the associated control means therefor may be utilized for providing controlled movement of the document holder 46. It will also be appreciated that the data stored in the memory (PROM) 138 would be varied in accordance with the type of drive means and control means employed. The function of the PROM 138 is to store data which will properly condition the control means for supplying a predetermined drive signal to the drive means in order to properly position the document holder 46 on any desired predetermined line. Accordingly, changes in the drive means and the control means coupled thereto may require the use of different data in the memory for each line desired to be printed upon to insure the locking in of the document holder 46 on the proper line after coincidence occurs, as has been previously discussed.

Since other modifications, varied to fit particular operating requirements and environments, will be apparent to those skilled in the art, the invention is not considered limited to the examples chosen for purposes of disclosure, and covers all changes and modifications which do not constitute departures from the true spirit and scope of this invention.

I claim:

1. A printing apparatus having a printer for printing on a document containing a stripe on which indicia with respect to the printing operation to be performed may be written and/or read therefrom by a scanner assembly, which indicia is used in the printing operation, comprising a. a document printing station for receiving a document which is to be printed upon having a stripe thereon on which indicia may be recorded and/or read pertaining to the print operation which is to be performed on said document, b. said document printing station having a scanner assembly carrying a transducer head adapted to scan the stripe of said document positioned when received in said document printing station and a document positioning means having a home position for positioning said document for scanning by said scanner assembly and a plurality of other positions corresponding to the positioning of said document by said document positioning means for the printing of one or more lines thereon, c. a document guide means mounted on said document printing station for guiding said document into said document positioning means, d. a transducer head aperture located in said document guide means for providing a travel path for said transducer head to scan said stripe, and e. a plurality of pivotal fingers pivotally suspended on the front of said transducer head aperture which are pivoted out of the way of the transducer head as said transducer head moves in said aperture and which functions to prevent said document from catching in said aperture or otherwise interfering with the proper insertion of said document into said document positioning means.

2. The method of printing on a bank passbook having a stripe thereon in a document printing station having a printer, a platen, a document positioning means having a home position and a plurality of other positions at which print operations are to be performed on said bank passbook, and a scanner assembly having a read/-write head thereon, comprising the steps of a. inserting said bank passbook in said document positioning means at said home position, b. actuating said platen for clamping said bank passbook below said stripe, c. scanning said stripe by the read/write head of said scanner assembly for reading the information on said stripe, d. retracting said platen, e. actuating said document positioning means in response to the information read by said read/write head from said stripe for positioning said bank passbook to the next line to be printed upon, f. actuating said platen to clamp said bank passbook in said document positioning means on the line to be printed upon, g. printing on said line by said printer, h. retracting said platen and returning said document positioning means to said home position, i. actuating said platen to clamp said bank passbook below said stripe, and j. actuating the read/write head of said scanner assembly for scanning said stripe and writing updated information thereon including the next line to be written on.

3. A printing apparatus having a printer for printing on a document containing a stripe on which indicia with respect to the printing operations to be performed may be written and/or read therefrom by a scanner assembly, which indicia is used in the printing operation, comprising a. a document printing station having a moveable document holder for receiving and positioning a document which is to be printed upon, said document having a stripe thereon on which indicia may be recorded and/or read pertaining to the print operation which is to be performed on said document, said document printing station having the printer for printing on said document, b. a scanner assembly on said document printing station carrying a transducer head for scanning said stripe of said document by said transducer head, c. drive means coupled to said document holder for providing controlled movement of said document holder containing said document with respect to said scanner assembly and said printer at said document printing station, d. said document holder having a home position for positioning said document for the scanning of said stripe thereon by said scanner assembly, and a plurality of other positions for the printing of one or more lines on said document in said document holder by said print means, e. a cam follower mounted on said scanner assembly, f. a track having a cam surface thereon on which said cam follower rides mounted on said document printing station, said cam surface being spaced from and positioned adjacent said stripe on said document when said document is positioned in said document holder in said home position for forcing said transducer head away from said stripe at said home position, said cam surface and said cam follower being disengaged during the scanning of said stripe by said transducer head, g. a document guide means mounted on said document printing station for guiding said document into said document holder, and a transducer head aperture located in said document guide means adjacent said stripe of said document when said document holder is in said home position for providing a travel path through said document guide means for said transducer head to scan said stripe, and h. a plurality of pivotal fingers are pivotally suspended on the front of said transducer head aperture which are pivoted out of the way of the transducer head as said transducer head moves in said aperture and which functions to prevent said document from catching in said aperture or otherwise interfering with the proper insertion of said document into said document positioning means.

4. The printing apparatus set forth in claim 3 having a plurality of position sensors located and spaced along said track of and actuated by said scanner assembly on movement along said track for generating position signals in accordance with the positions of said transducer head which signals may be used for actuating control functions in the printing operations of said printing apparatus.

5. The printing apparatus set forth in claim 4 wherein said position sensors are provided for a beginning-of-stripe position, head-in-contact position, and an end-of-stripe position.

6. The printing apparatus set forth in claim 5 wherein said document in a bank passbook having indicia with respect to an account number and the next line to be printed on recorded on said stripe.

7. The printing apparatus set forth in claim 6 wherein said scanner assembly scans a said transducer head over said stripe for reading and generating stripe signals in accordance with the indicia on said stripe, and including means sequenced by said stripe signals for actuating said drive means of said document holder to position said bank passbook to the next line to be printed on in said document printing station.

8. The printing apparatus Set forth in claim 7 including sequencing means wherein said printer is sequenced to print a line or lines on said bank passbook after said bank passbook is properly positioned for the printing thereon in accordance with the line information in said stripe signals read from said stripe, said drive means for said document holder sequenced by the end of said print operation for moving said document holder and said bank passbook to said home position, and means sequenced by the return of said document holder to said home position for actuating said transducer head for writing on said stripe to update the information thereon whereby subsequent print operations may be controlled by said stripe.

* * * * *